US005946536A

United States Patent [19]

Suzuki

[11] Patent Number: 5,946,536

[45] Date of Patent: Aug. 31, 1999

[54] DEVELOPING DEVICE HAVING A DEVELOPING ROLLER WITH A RUGGED SURFACE FOR RECEIVING TONES PARTICLES

[75] Inventor: Tsuyoshi Suzuki, Owariasahi, Japan

[73] Assignee: Brother Kogyo Kabushiki Kaisha, Nagoya, Japan

[21] Appl. No.: 08/862,402

[22] Filed: May 23, 1997

[30] Foreign Application Priority Data

May 27, 1996 [JP] Japan ..... 8-132044

[51] Int. Cl.[6] ..... G03G 15/08

[52] U.S. Cl. ..... 399/286; 492/30; 492/53

[58] Field of Search ..... 399/279, 286; 492/28, 30, 53, 56

[56] References Cited

U.S. PATENT DOCUMENTS 5,110,705 5/1992 Hosoya et al. .

5,565,968 10/1996 Sawa et al. .

*Primary Examiner*—Richard Moses

*Attorney, Agent, or Firm*—Oliff & Berridge, PLC

[57] ABSTRACT

A developing roller 19 is formed of a blend material produced of silicone rubber and EPDM, which has good abrasion proof, and subjected to a rubbing process to rub a surface of the developing roller 19 until convex portions 19A formed on the surface become less than two times a particle diameter (5–10 μm) of toner T, i.e., 10–20 μm. Accordingly, the surface condition of the developing roller is not changed for a long time and thus the toner T can uniformly be carried on the surface of the developing roller 19, forming a uniform thickness toner layer, thereby enabling to uniformly charge the toner layer. Uniformly charged toner layer on the surface of the developing roller 19 thus makes it possible to develop an electrostatic latent image formed on a photosensitive drum 12 with uniform toner density, causing no difference in toner density. When the developed image on the photosensitive drum 12 is transferred to a sheet 50, a resultant image with uniform image density can be formed on the sheet 50.

12 Claims, 6 Drawing Sheets

PRIOR ART

PRIOR ART

DEVELOPING DEVICE HAVING A DEVELOPING ROLLER WITH A RUGGED SURFACE FOR RECEIVING TONES PARTICLES

BACKGROUND OF THE INVENTION

1. Field of the Invention

The present invention relates to a developing device for use in an image forming apparatus such as a laser printer, etc., for developing an electrostatic latent image by supplying toner to the electrostatic latent image formed on an outer peripheral surface of a photosensitive drum and transferring the image developed on the surface of the photosensitive drum onto a sheet, and particularly to a developing device in an image forming apparatus, capable of providing a toner layer which is supplied on a surface of a developing roller so as to be uniform in thickness by making a surface of a developing roller into a rugged surface provided with convex portions having a height approximately equal to a diameter of a toner particle to be supplied thereon, thus enabling to evenly charge the toner layer to form a resultant image, i.e., a visual image with uniform image density.

2. Description of Related Art

Regarding conventional developing devices for use in image forming apparatuses such as laser printers, etc., there have been proposed various types of the devices, which are in general constructed of a toner storing member including a toner cartridge for storing therein toner, a toner supply roller for supplying toner from the toner storing member, and a developing roller for developing an electrostatic latent image on a photosensitive drum by supplying the toner provided from the toner supply roller onto the image. One embodiment of the developing device will be explained with reference to FIG. 6. FIG. 6 is an explanatory view showing schematically a main construction of the developing device in the prior art.

In FIG. 6, the developing device has a toner cartridge 100 which accommodates therein toner and is provided with an opening for toner supply at an almost center in its width direction. This toner cartridge 100 is provided therein with an agitator 103 for agitating toner to supply same into a developing chamber 102 side through a toner supply port 101. A frame F of the developing device is provided with an opening for toner supply positioned correspondingly to the toner supply opening of the toner cartridge 100. Those openings of the toner cartridge 100 and the frame F form the toner supply port 101 in combination with each other. Inside the developing chamber 102 constructed of an upper frame F1 and a lower frame F2 of the frame F, a toner supply roller 104 is arranged rotatably in a lower frame F2 side, for supplying the toner supplied through the toner supply port 101 to a developing roller 105.

Here, the developing roller 105 used in the conventional developing device will be explained with reference to FIG. 7. FIG. 7 is an enlarged view showing a part of the developing roller in the prior art.

This developing roller 105 is usually formed of silicone rubber because it is excellent in a charging performance to frictionally charge toner although it is not very high in abrasion resistance. The surface of the developing roller 105 is subjected to a rubbing process so as to become about 3–6 μm at ten points average roughness. When the rubbing process is applied to silicone rubber to obtain the above surface roughness, however, the rubbed surface of the developing roller 105 is actually rugged, having concave portions 105A with a depth X being about several ten μm and convex portions 105B with a cycle, i.e., a distance between the convex portions 105B being about some hundreds μm, as shown in FIG. 7. This is due to that the silicone rubber is coparatively soft material. At this time, the diameter of a toner particle T carried in each concave portion 105A is generally about 5–10 μm.

Furthermore, on an internal wall of the upper frame F1, above the developing roller 105, a blade 107 is fixedly secured with a fixing element 106, whereby regulating a thickness of the toner layer supplied on the surface of the developing roller 105. This developing roller 105 is also arranged in contact with a photosensitive drum 108. On the peripheral surface of the photosensitive drum 108 is formed an electrostatic latent image by an image exposure device not shown which performs a scanning operation with a laser beam in accordance with image data. The developing roller 105 supplies toner to the electrostatic latent image formed on the peripheral surface of the photosensitive drum 108 to develop the image. The image developed on the surface of the photosensitive drum 108 is then transferred onto a sheet fed from a sheet feeder not shown, forming the resultant image thereon.

On the surface of the developing roller 105 used in the conventional developing device, even if the developing roller 105 is a new article, however, formed are concave portions 105A each having a depth X of about several ten μm and convex portions 105B having a cycle Y between those convex portions 105B of some hundreds μm. Therefore, it is not too much to say that the surface of the developing roller 105 is in a very rough condition. The diameter of a toner particle T held in the concave portions 105A is usually 5–10 μm, so that there is a large difference in size between the depth X of the concave portions 105A and the toner particle T. Accordingly, the toner particles T tend to be held inside the concave portions 105A as shown in FIG. 7.

When the toner particles T are carried on the surface of the developing roller 105, therefore, the toner particles T largely tend to be held inside the concave portions 105A rather than on the convex portions 105B, so that the toner particles T supplied on the surface of the developing roller 105 form partially a thin layer and a thick layer. This causes a problem that it is extremely difficult to hold the toner particles T as a layer with a uniform thickness on the surface of the developing roller 105.

By the way, it will be conceivable that size of the concave portions 105A on the developing roller 105 gradually changes in small size while being used for image forming. This is due to the same reason described above that the silicone rubber is comparatively soft material, thus, the surface condition of the developing roller 105, in which the size of the concave portions 105A is big size when the developing roller 105 is a new article, is remarkably changed in comparison with the surface condition of the developing roller 105, in which the size of the concave portions 105A is small size after the developing roller 105 is used for a predetermined time. Therefore, it concludes that the layer of the toner particles T with uniform thickness cannot be formed on the surface of the developing roller 105 over the period passing until the developing roller 105 is used for a predetermined time from a start of use thereof.

As mentioned above, when the layer of toner particles T is uneven in thickness on the developing roller 105, it is impossible to uniformly charge the toner T, the charging being performed by a friction between a supply roller 104 and the developing roller 105 and between a blade 107 and the same, and a voltage applied to the developing roller.

Consequently, it causes that the toner is unevenly supplied to the electrostatic latent image formed on the photosensitive drum 108 in a development operation on the image. Thus, a resultant image can not be formed with uniform image density.

SUMMARY OF THE INVENTION

The present invention has been made in view of the above circumstances and has an object to overcome the above problems and to provide a developing device for use in an image forming apparatus, capable of forming a toner layer with a uniform thickness on a surface of a developing roller by using the developing roller which is made of blend material produced by mixing silicone rubber and EPDM (ethylene-propylene-diene ternary copolymer), the blend material having good abrasion proof, so that surface condition of the developing roller is not changed for a long time, whereby enabling to uniformly charge the toner layer, and forming the resultant image with uniform image density without unevenness in density.

And the present invention has another object to provide a developing device, capable of forming the toner layer with a uniform thickness on the developing roller by making a surface of the developing roller into a rugged surface with convex portions each having a height as much as a diameter of a toner particle, whereby enabling to uniformly charge the toner layer, and forming the resultant image with uniform image density without unevenness in density.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a developing device in claim 1 of the present invention comprises a toner storing member, a toner supply roller for supplying toner transported from the toner storing member, and a developing roller for developing an electrostatic latent image formed on an outer peripheral surface of a photosensitive drum by supplying toner to the image, the developing roller being formed of blend material produced by mixing silicone rubber and EPDM (ethylene-propylene-diene ternary copolymer).

According to the developing device of the present invention, the developing roller formed of the above blend material which has good abrasion proof is used to supply toner to an electrostatic latent image formed on an outer peripheral surface of the photosensitive drum thereby to develop the electrostatic latent image, so that the surface condition of the developing roller is not changed for a long period, whereby enabling the uniform charging of toner supplied on the developing roller, and forming a resultant image with uniform image density without unevenness in density.

In another aspect of the present invention, there is provided a developing device comprises a toner storing member, a toner supply roller for supplying toner transported from the toner storing member, and a developing roller for developing an electrostatic latent image formed on an outer peripheral surface of a photosensitive drum by supplying toner to the image, the developing roller being formed of hard material which is reformed so as to have high abrasion proof and being designed to have the height of convex portions smaller than two times a particle diameter of the toner.

According to the above present invention, the developing roller is formed of hard material reformed to have the high abrasion proof, and it is provided convex portions having the height less than two times each diameter of toner particles, so that the toner particles can be carried uniformly in thickness on the surface of the developing roller and thereby be evenly charged. It is therefore possible to develop the electrostatic latent image formed on the photosensitive drum with uniform toner density, thereby preventing the occurrence of uneven toner density, resulting in forming a resultant image which is uniform in image density on a sheet.

In further aspect of the present invention, there is provided a developing device comprising a toner storing member, a toner supply roller for supplying toner transported from the toner storing member, and a developing roller for developing an electrostatic latent image formed on an outer peripheral surface of a photosensitive drum by supplying toner to the image, the developing roller being mainly formed of silicone rubber and a surface of the developing roller being made into a rugged surface with convex portions each having a height almost equal to a particle diameter of said toner.

According to the developing device of the present invention, the developing roller is mainly formed of silicone rubber and its surface is made into a rugged surface with convex portions each having a height as much as a diameter of a toner particle, so that the toner particles can be held on the developing roller as a toner layer uniform in thickness, thereby enabling to uniformly charge the toner layer. The developing roller serves to supply the toner to an electrostatic latent image formed on the outer peripheral surface of the photosensitive drum, thereby to develop the electrostatic latent image. At this time, the toner layer can uniformly be charged, so that there occurs no unevenness in toner density in developing the electrostatic latent image on the photosensitive drum, thus resulting in obtaining a resultant image with uniform image density.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention. In the drawings.

DETAILED DESCRIPTION OF THE PREFERRED EMBODIMENTS

A detailed description of a preferred embodiment of a developing device for use in an image forming apparatus, specifically in a laser printer, embodying the present invention will now be given referring to the accompanying drawings.

Figure 1:
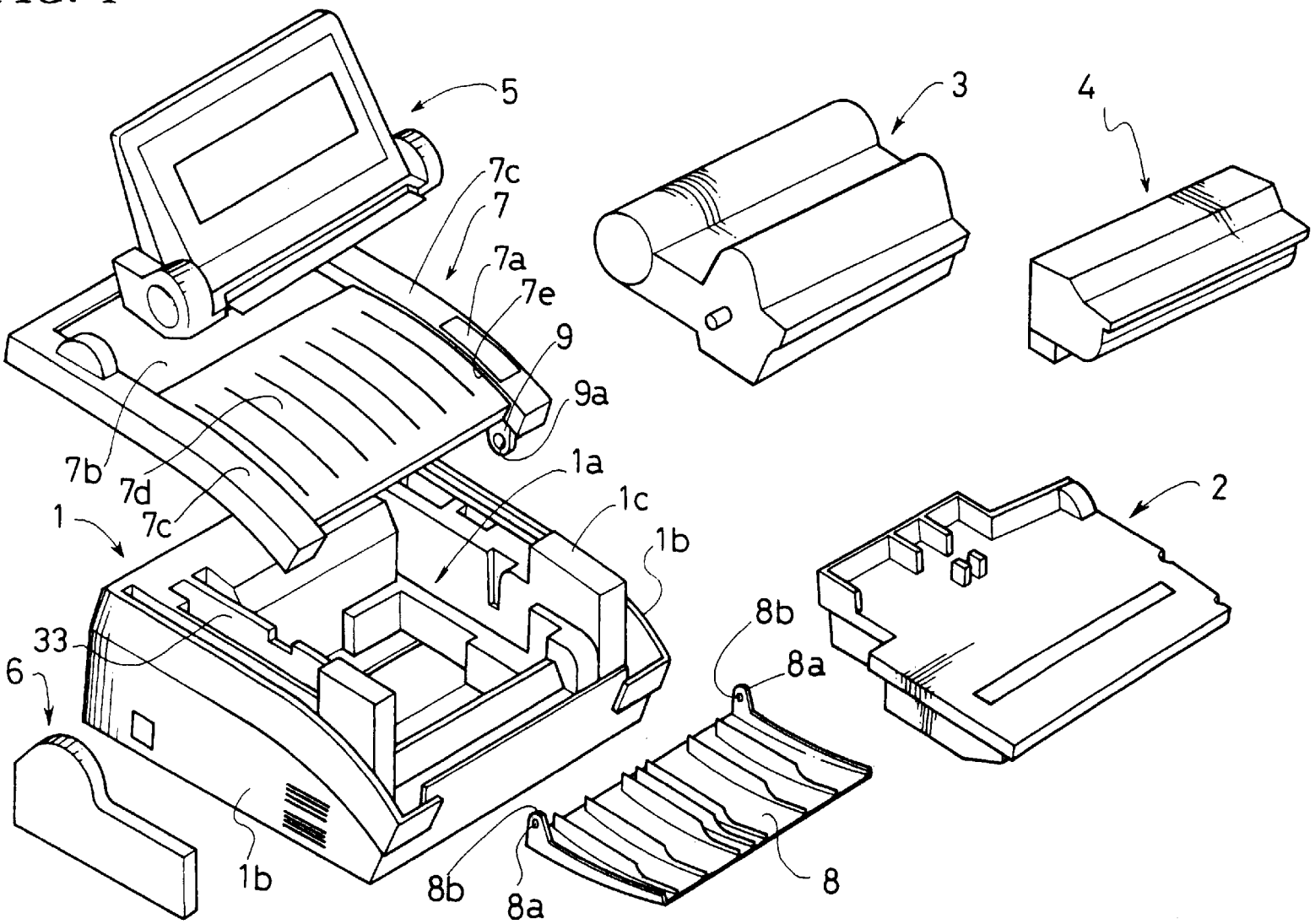
FIG. 1 is a perspective exploded view of main components of a laser printer in an embodiment according to the present invention.
Figure 2:
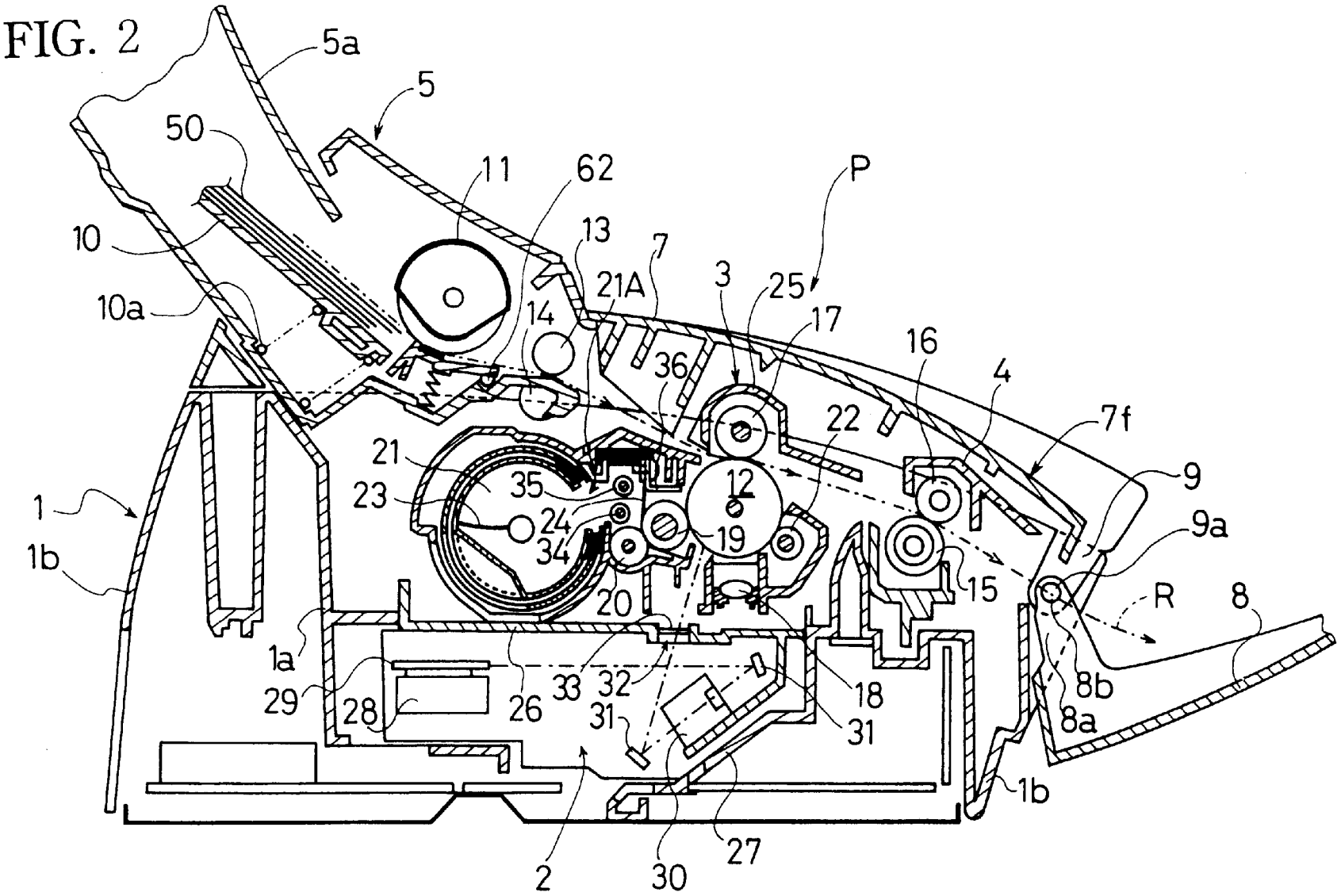
FIG. 2 is a sectional side view of the laser printer of FIG. 1.

First, schematic construction of a laser printer P in an embodiment will be described with reference to FIGS. 1 and 2. FIG. 1 is a perspective exploded view of a main construction of the laser printer P. FIG. 2 is a sectional side view of the laser printer P.

In FIG. 1, a main housing 1 of the laser printer P is formed integrally of a main frame 1*a* and a main cover 1*b* by, for example, an injection molding process. In the main unit 1*a*, set are a scanner unit 2, a process unit 3, a fixing unit 4, and a sheet supply unit 5 from above the main unit 1*a*. The main cover 1*b* serves to cover the outer peripheral four side surfaces, i.e., a front, back, right, and left sides, of the main frame 1*a*. In a holding recess 33 defined by the outer surface of the main frame 1*a* and the inner surface of the main cover 1*b*, a driving system unit 6 including a driving motor and a train of gears is installed and fixed from the lower side of the main housing 1.

The main frame 1*a* is provided an operational panel 1*c* formed extruding upward. Both upper surfaces of the main frame 1*a* and the main cover 1*b* are covered with an upper cover 7. This upper cover 7 is provided with a hole 7*a* through which the operational panel 1*c* can be inserted and an opening 7*b* through which a base part of the sheet supply unit can be inserted. At both sides in a front side of the upper cover 7 (a right side in FIG. 1), a pair of brackets 9 each having a support shaft 9*a* extruding opposite to each other (only one of them is shown in FIG. 1). A sheet discharge tray 8 is provided with support portions 8*a* formed at both end sides thereof and bores 8*b* formed in the support portions 8*a*. Each of the bores 8*b* can be fitted to each support shaft 9*a* of the brackets 9 so that the sheet discharge tray 8 is supported rotatably with respect to the upper cover 7. On the upper surface of the upper cover 7, there are provided step portions 7*e* between the upper surfaces of side parts 7*c* and the upper surface of a center part 7*d*. Such the step portions 7*e* form a holding recess 7*f* as shown in FIG. 2 for holding the sheet discharge tray 8 in the center part 7*d* of the upper cover 7 during non-use of the tray 8. The sheet discharge tray 8 in non-use can be held in the holding recess 7*f* by turning about the support portions 8*a* so as to be held in the upper cover 7 and, to the contrary, it can be set for use at a position to stack the sheets discharged from the fixing unit 4 by turning contrariwise from the held position to a stack position shown in FIG. 2.

Next, the schematic internal structure of the laser printer P will more detail be explained referring to FIG. 2. In FIG. 2, sheets 50 are held as stacked in a feeder case 5*a* of the sheet supply unit 5. The tip end of each sheet 50 is pressed against a sheet supply roller 11 by a support plate 10 provided with a biasing spring 10*a*, disposed inside the feeder case 5*a*. The sheet supply roller 11 is driven to rotate by a driving power transmitted from the driving system unit 6 and transport individual sheets from the feeder case 5*a* in cooperation with a sheet separating member 62. The sheet 50 individually separated from the sheet stack is transported to the process unit 3 by means of a pair of resist rollers 13 and 14.

The process unit 3 is a unit to perform a toner development of electrostatic latent image by supplying toner to the electrostatic latent image formed on the peripheral surface of the photosensitive drum 12 by means of a laser optical system which will be mentioned later, provided in the scanner unit 2 in accordance with image data. More specifically, the process unit 3 is constructed of the photosensitive drum 12, a transfer roller 17 disposed above the photosensitive drum 12 and in contact therewith, a charger 18 such as a Scorotron type of charger, disposed under the photosensitive drum 12, a developing unit including a developing roller 19 disposed upstream of the photosensitive drum 12 in a sheet feeding direction and a toner supply roller 20, a toner cartridge 21 attachably and detachably disposed upstream of the developing unit, which serves as a toner storing unit, and a cleaning roller 22 disposed downstream of the photosensitive drum 12, and other components.

Figure 5:
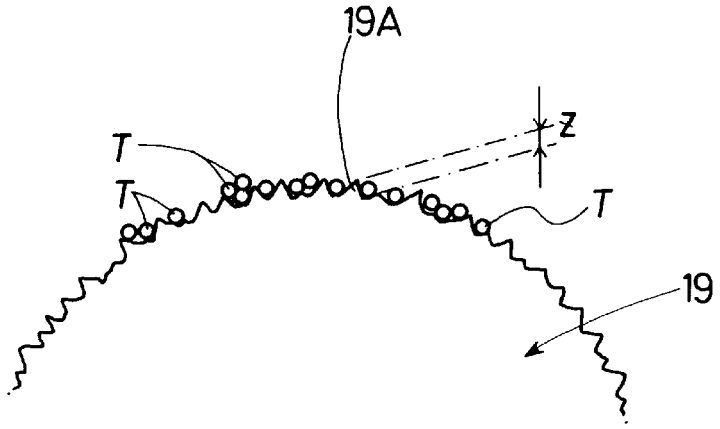
FIG. 5 is an enlarged view of a developing roller in the embodiment.
Figure 6:
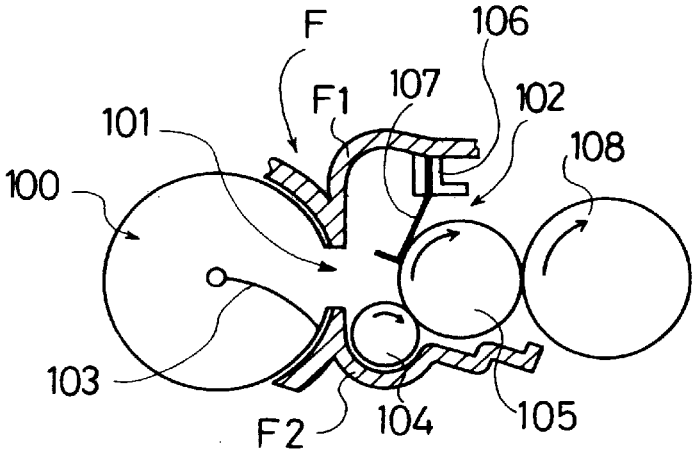
FIG. 6 is an explanatory view schematically showing a main part of a developing device in the prior art.
Figure 7:
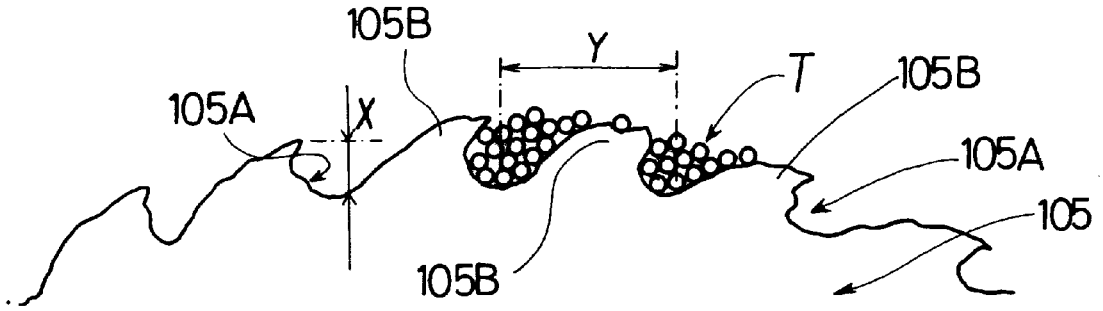
FIG. 7 is an explanatory view schematically showing a part of a developing roller in the prior art.

Next, the developing roller 19 will be explained with reference to FIG. 5 hereinafter. FIG. 5 is an enlarged view of a part of the developing roller 19. This developing roller 19 is formed of a blend material produced by mixing silicone rubber and EPDM (ethylene-propylene-diene ternary copolymer) at a predetermined ratio in consideration of an excellent charging performance thereof. Such the blend material having good abrasion proof, the surface condition of the developing roller is not changed for a long time, making it possible to uniformly charge the toner layer and to form a resultant image with uniform image density. The developing roller 19 is subjected to a rubbing process so that the surface thereof becomes about 6–8 $\mu$m at ten points average surface roughness Rz, forming a rugged surface with convex portions 19A each having a height as much as the particle diameter (about 5–10 $\mu$m) of the toner particle T. Performing a rubbing process while setting a target to the above surface roughness can prevent the production of the periodic large ruggedness in the prior art. Specifically, as shown in FIG. 5, the surface of the developing roller 19 is rubbed so that the height Z of the convex portion 19A may become less than two times the particle diameter of the toner particle T, i.e., the height Z of the convex portion 19A may be in a range of 10–20 $\mu$m.

Here, in the above blend material, it may be added kaolinite which has a characteristic to increase abrasion proof of the material, similarly to EPDM, in addition to increase charging ability thereof. Therefore, it is effective to add kaolinite in the above blent material.

In the case that the surface of the developing roller 19 is rubbed so that the height Z of the convex portion 19A formed on the surface becomes less than two times the diameter of the toner particle T, as shown in FIG. 5, the toner particles T can be carried uniformly in thickness, forming a toner layer, on the surface of the developing roller 19, thereby enabling to uniformly charge the toner layer. In addition, as the toner layer on the surface of the developing roller 19 can uniformly be charged, a toner development on the electrostatic latent image formed on the photosensitive drum 12 can be achieved with even toner density. Consequently, when the developed image on the photosensitive drum 12 is then transferred to the sheet 50, a resultant image (visual image) which is uniform in image density can be formed on the sheet 50.

As shown in FIG. 1, inside of the developing chamber of the developing unit, a pair of auger rollers, namely, a lower auger roller 34 and an upper auger roller 35, are rotatably provided above the toner supply roller 20. This lower auger roller 34 functions to transport the toner that is supplied from the toner cartridge 21 via a toner supply port 21A into the developing chamber, toward both sides of the toner supply roller 20 above the toner supply roller 20. The toner supply port 21A is constructed of an opening formed in the toner cartridge at an almost center position thereof and an opening formed in a unit frame 25. The upper auger roller 35 functions to transport the toner from the both sides of the toner supply roller 20 toward the toner supply port 21A. In this way, the toner is supplied from the toner supply port 21A to the developing chamber side by means of the upper and lower auger rollers 35 and 34, thereby to circulate above the toner supply roller 20 in the both sides thereof. While circulating, the toner is supplied to and stuck on the toner supply roller 20. The detail structure of each of the lower auger roller 34 and the upper auger roller 35 will be described later.

Above the developing roller 19, a blade 24 is secured with an L-shaped blade fixing element 36 on the lower surface of the unit frame 25. The blade 24 serves to regulate the thickness of a layer of toner supplied on the developing roller 19 from the toner supply roller 20 into a predetermined thickness.

On the outer peripheral surface of the photosensitive drum 12, an electrically charged layer is formed by the charger 18 and, then, an electrostatic latent image is formed thereon by scanning with a laser beam by means of the scanner unit 2. The toner stored in the toner cartridge 21 is stirred by an agitator 23 thereby to discharge the toner through the toner supply port 21A toward the developing chamber, and is carried on the outer peripheral surface of the developing roller 19 via the toner supply roller 20, where the toner on the developing roller 19 is regulated to form a toner layer having a predetermined thickness by means of the blade 24. When the toner is transported from the developing roller 19 to and stuck on the photosensitive drum 12, the electrostatic latent image formed on the photosensitive drum 12 is visualized and transferred to the sheet 50 passing between the transfer roller 17 and the photosensitive drum 12. The residual toner remaining on the photosensitive drum 12 is transported to the cleaning roller 22.

The process unit 3 constructed above is made as a cartridge type by assembling all components into the unit frame 25 formed of synthetic resin. This cartridge-type process unit 3 is detachably and attachably mounted in the main frame 1*a*.

The scanner unit 2 is provided with a well known laser optical system and makes a scanning on the photosensitive drum 12 by the laser optical system in accordance with predetermined image data, thereby forming an electrostatic latent image on the photosensitive drum 12. More specifically, the scanner unit 2 is arranged under the process unit 3 and a scanner cover 26 is attached on the upper surface of the scanner unit 3. This scanner cover 26 is fixed at the upstream side of a bottom plate 27 of the main frame 1*a*, covering substantially the whole opening of the main frame 1*a*, and is provided an oblong scanner hole 32 extending along the axis line of the photosensitive drum 12. The scanner unit 2 serving as an exposure unit is provided with a laser emitting element not shown, a scanner motor 28, a polygon mirror 29, a lens 30, and a reflecting mirror 31, in which a laser beam is allowed to pass through a glass plate 33 inserted in the oblong scanner hole 32 formed in the scanner cover 26 and emitted to the outer peripheral surface of the photosensitive drum 12 in the process unit 3. Accordingly, the electrostatic latent image is exposed on the outer peripheral surface of the photosensitive drum 12 in accordance with the image data. To the electrostatic latent image formed on the photosensitive drum 12 by the laser optical system of the scanner unit 2 in the above way, the toner is supplied through the process unit 3, performing a toner development of the electrostatic latent image.

The toner developed image based on the electrostatic latent image formed on the photosensitive drum 12 in the process unit 3 is transferred onto the sheet 50 fed to the process unit 3. After that, the sheet 50 is transported to the fixing unit 4 where the toner image transferred onto the sheet 50 is subjected to a heat fixing process by means of a pair of a heat roller 15 and a pressure roller 16. The sheet 50 on which the resultant image is formed is then discharged by the rollers 15 and 16 and stacked onto the sheet discharge tray 8 disposed at a stack position. A trace along which the sheet 50 is transported from the sheet supply unit 5 to the sheet discharge tray 8 is indicated by a two-dot chain line R in FIG. 2.

Figure 3:
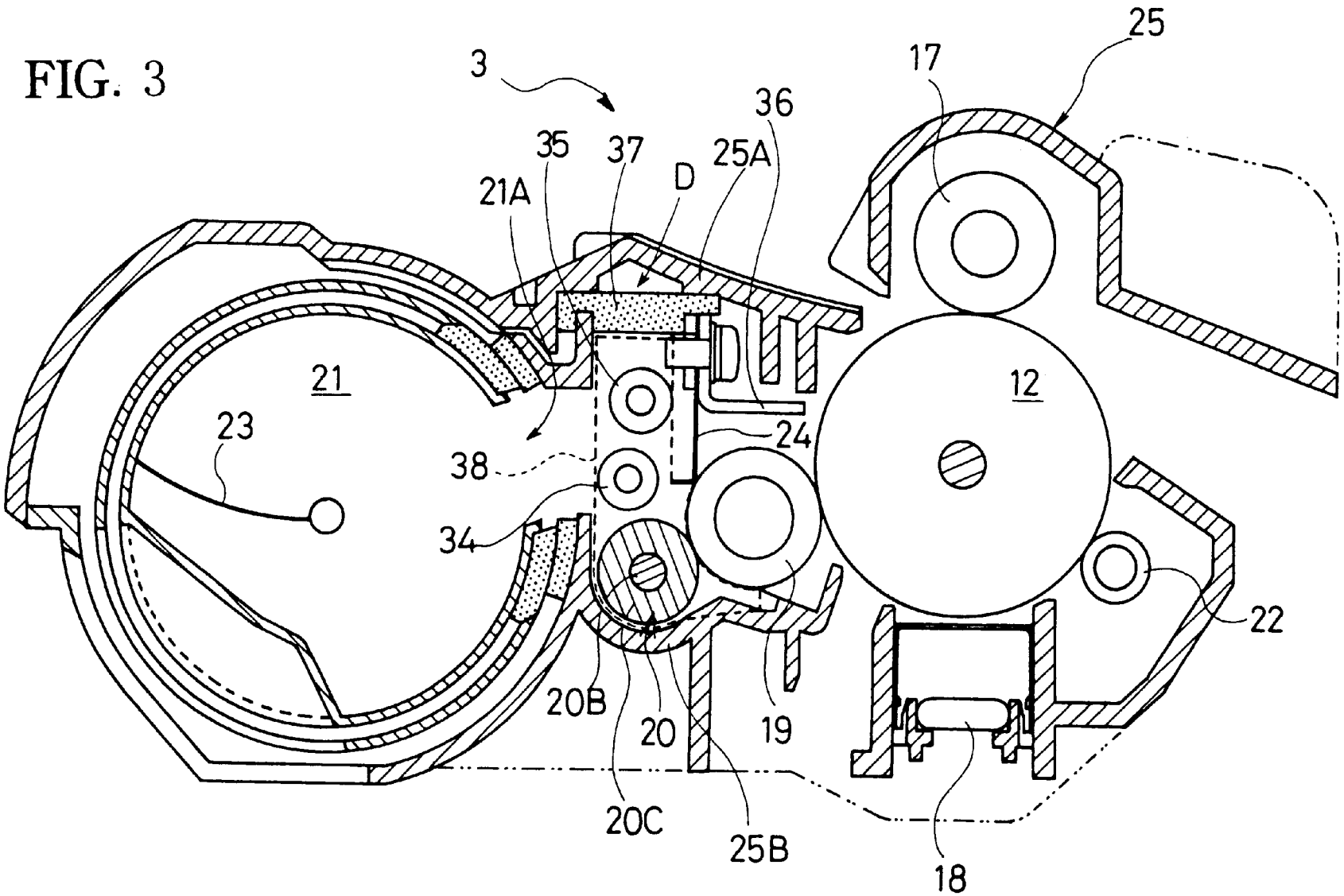
FIG. 3 is a sectional side view of a process unit of the laser printer of FIG. 1.

Next, the detail structure of the developing chamber in the process unit 3 will be described with reference to FIG. 3 and FIG. 4 hereinafter. FIG. 3 is a sectional side view of the process unit 3 and FIG. 4 is an enlarged view of the developing chamber.

Figure 4:
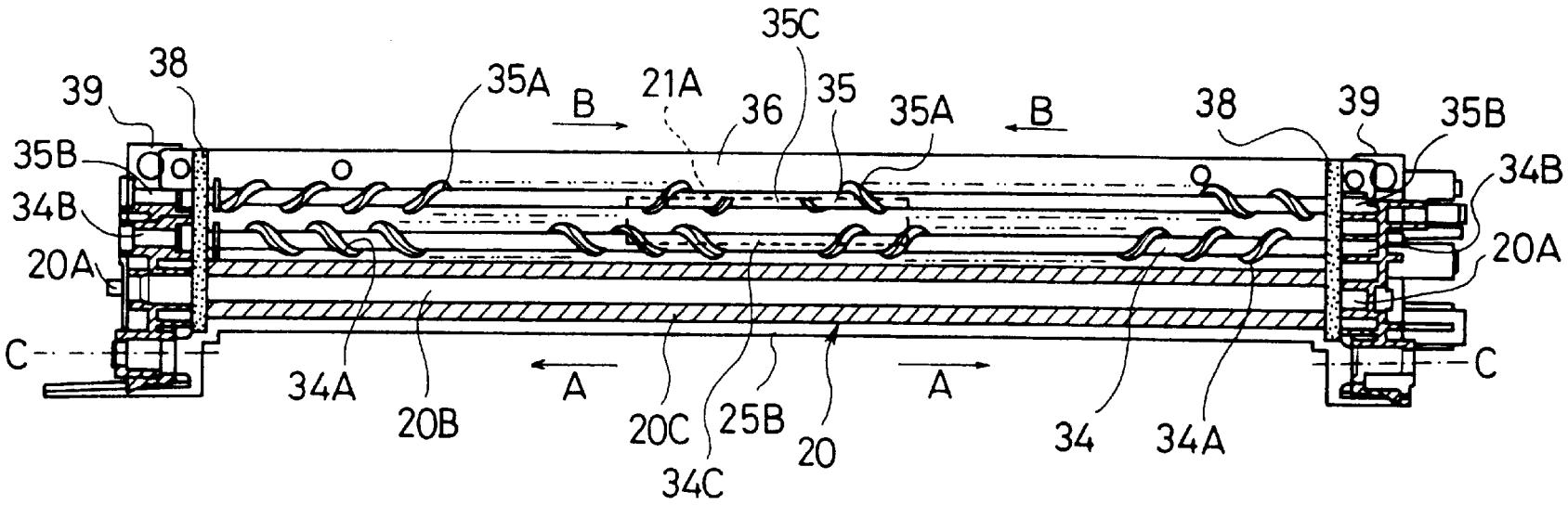
FIG. 4 is a sectional front view showing the internal construction of a developing chamber in the embodiment.

The developing chamber D is a space surrounded by an upper seal member 37 disposed at a lower surface of an upper frame 25A of the unit frame 25, a lower frame 25B of the unit frame 25, and a pair of side seal members 38 shown in FIG. 4 formed of a sponge material, disposed at both sides inside the developing chamber D. The toner supply roller 20 is constructed of a main shaft 20B provided at its both ends with end shafts 20A, and a roller member 20C formed of a sponge material covering the main shaft 20B in its overall length. Each of the end shafts 20A is inserted in a hole of the side seal member 38 and supported at its outer side with each of a pair of support plates 39 attached rotatably to the lower frame 25B.

Meanwhile, the turning center of each supporting plate 39 is indicated by a dashed line C in FIG. 4. Each supporting plate 39 also supports rotatably the developing roller 19, so that each supporting plate 39 is biased in a clockwise direction in FIG. 3 by means of a biasing spring (not shown) to turn clockwise about the center C, allowing the developing roller 19 to come into contact with the photosensitive drum 12. With each supporting plate 39, the toner supply roller 20, the upper and lower auger rollers 35 and 34, and the developing roller 19 are supported integrally, making it possible to easily regulate a positional relation among the above components by handling them as a unit and thus to easily conduct the maintenance thereof.

As shown in FIG. 4, further, the lower auger roller 34 in which a center portion 34C thereof is substantially correspondent to a position where the toner supply port 21A is formed (corresponding to a center portion of the toner supply port 21A), is provided with spiral teeth 34A formed spirally extending from the center portion 34C toward opposite ends of the auger roller 34 on the outer surface thereof. A roller shaft 34B of the auger roller 34 is supported at both ends by the support plates 39 as well as the toner supply roller 20. When the lower auger roller 34 is rotated clockwise in FIG. 3, accordingly, the toner supplied from the toner supply port 21A is transported successively along the spiral teeth 34A above the toner supply roller 20 toward both ends of the developing chamber D in opposite directions indicated by arrows A. Similarly, a center portion 35C of the upper auger roller 35 is substantially correspondent to a position where the toner supply port 21A is formed (corresponding to a center portion of the toner supply port 21A). The upper auger roller 35 is provided with spiral teeth 35A formed spirally extending from both ends of the auger roller 35 toward the center portion 35C. A roller shaft 35B of the auger roller 35 is supported with the supporting shafts 39 as well as the upper auger roller 34. When the upper auger roller 35 is rotated clockwise in FIG. 3 and the toner transported by the lower auger roller 34 toward the both ends of the developing chamber D is so increased to reach the upper auger roller 35, the toner is transported successively along the spiral teeth 35A in directions indicated by arrows B toward the toner supply port 21A. Thus, a part of the toner is return to the toner cartridge 21 through the toner supply port 21A. In this way, the toner not used for image development is circulated as above and returned to the toner cartridge 21, so that it can prevent toner from remaining in the developing chamber D for a long time. This makes it possible to supply constantly fresh toner from the toner cartridge 21. Even if the toner is not returned to the toner cartridge 21, stirring and circulating by the upper and lower auger rollers 35 and 34 makes toner smoothly flow in the developing chamber D without causing agglomeration of toner.

As mentioned above, each of the upper and lower auger rollers 35 and 34 serves to transport and circulate the toner supplied from the toner supply port 21A into the developing chamber D, above the toner supply roller 20, thereby enabling uniform sticking of toner to all the toner supply roller 20 over without allowing the toner to remain in a limited part. As toner is transported and circulated above the toner supply roller 20 and in its both side directions by means of the upper and lower auger rollers 35 and 34, constantly fresh toner can be stuck on all over the toner supply roller 20, making it possible to supply uniformly toner to the developing roller 19 and the electrostatic latent image formed on the outer peripheral surface of the photosensitive drum 12, thereby to form for a long time the resultant image excellent in quality.

As above, the forming position of the toner supply port 21A in the toner cartridge 21 (a center position of the toner supply port 21A) substantially coincides with the center positions 35C and 34C of the upper and lower auger rollers 35 and 34, so that the toner discharged through the toner supply port 21A can efficiently be transported and circulated above the toner supply roller 20 via the upper and lower auger rollers 35 and 34.

As explained in detail above, the developing device according to the present invention, the developing roller 19 is formed of a blend material produced by mixing silicon rubber and EPDM and is subjected to a rubbing process so that a height of the convex portion 19A on the surface of the developing roller 19 becomes less than two times a diameter (5–10 $\mu$m) of a toner particle T, i.e., 10–20 $\mu$m, and a surface roughness of the developing roller 19 becomes 6–8 $\mu$m at the ten points average surface roughness Rz. As a result, the toner particles T can be carried uniformly in layer thickness on the surface of the developing roller 19, making it possible to uniformly charge the toner layer. Due to the uniformly charged toner layer on the surface of the developing roller 19, the electrostatic latent image formed on the photosensitive drum 12 can be developed with even toner density. Thus, when the image developed with the toner on the photosensitive drum 12 is transferred to the sheet 50, a resultant image with uniform image density can be formed on the sheet 50.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A developing devices, comprising:

a toner storing member;

a toner supply roller for supplying toner transported from the toner storing member; and a developing roller for developing an electrostatic latent image formed on an outer peripheral surface of a photosensitive drum by supplying toner to the image, the developing roller being formed of blend material produced by mixing silicone rubber and EPDM (ethylene-propylene-diene ternary copolymer) with kaolinite and having a rugged surface with convex portions, each convex portion having a height almost equal to a particle diameter of the toner.

2. A developing device according to claim 1, wherein the rugged surface of said developing roller is designed to have the height of the convex portions smaller than two times the particle diameter of the toner.

3. A developing device according to claim 2, wherein the average particle diameter of the toner is determined in a range of 5–10 $\mu$m, and the height of the convex portions in the rugged surface of the developing roller is determined in a range of 10–20 $\mu$m.

4. A developing device according to claim 1, wherein a surface roughness of said developing roller is determined in a range of 6–8 $\mu$m at ten points average roughness Rz.

5. A developing device comprising:

a toner storing member;

a toner supply roller for supplying toner transported from the toner storing member; and a developing roller for developing an electrostatic latent image formed on an outer peripheral surface of a photosensitive drum by supplying toner to the image, the developing roller being formed of hard material in which kaolinite is added so as to have high abrasion resistance and being designed to have the height of the convex portions smaller than two times the particle diameter of the toner.

6. A developing device according to claim 5, wherein the average particle diameter of the toner is determined in a range of 5–10 $\mu$m, and the height of the convex portions in the rugged surface of the developing roller is determined in a range of 10–20 $\mu$m.

7. A developing device according to claim 5, wherein a surface roughness of said developing roller is determined in a range of 6–8 $\mu$m at ten points average roughness Rz.

8. A developing device according to claim 5, wherein the hard material of the developing roller is made of blend material produced by mixing silicone rubber and EPDM.

9. A developing device, comprising:

a toner storing member;

a toner supply roller for supplying toner transported from the toner storing member; and a developing roller for developing an electrostatic latent image formed on an outer peripheral surface of a photosensitive drum by supplying toner to the image, the developing roller being formed of blend material produced by mixing silicone rubber and EPDM (ethylene-propylene-diene ternary copolymer) with kaolinite and a surface of the developing roller being made into a rugged surface with convex portions each having a height almost equal to a particle diameter of said toner.

10. A developing device according to claim 9, wherein the rugged surface of said developing roller is designed to have the height of the convex portions smaller than two times the particle diameter of the toner.

11. A developing device according to claim 9, wherein the average particle diameter of the toner is determined in a range of 5–10 $\mu$m, and the height of the convex portions in the rugged surface of the developing roller is determined in a range of 10–20 $\mu$m.

12. A developing device according to claim 9, wherein a surface roughness of said developing roller is determined in a range of 6–8 $\mu$m at ten points average roughness Rz.

* * * * *